US009616905B2

(12) United States Patent
Kernwein et al.

(10) Patent No.: US 9,616,905 B2
(45) Date of Patent: Apr. 11, 2017

(54) TRAIN NAVIGATION SYSTEM AND METHOD

(71) Applicant: Westinghouse Air Brake Technologies Corporation, Wilmerding, PA (US)

(72) Inventors: Jeffrey D. Kernwein, Cedar Rapids, IA (US); Kendrick W. Gawne, Cedar Rapids, IA (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 14/728,758

(22) Filed: Jun. 2, 2015

(65) Prior Publication Data

US 2016/0355199 A1 Dec. 8, 2016

(51) Int. Cl.

| | |
|---|---|
| ***B61L 25/02*** | (2006.01) |
| ***B61L 11/08*** | (2006.01) |
| ***B61L 1/02*** | (2006.01) |

(52) U.S. Cl.

CPC ..... *B61L 11/08* (2013.01); *B61L 1/02* (2013.01); *B61L 25/021* (2013.01)

(58) Field of Classification Search

CPC ..... B61F 3/06; B61K 3/02; B61L 2205/04; B61L 23/042; B61L 25/025; B61L 25/026; B61L 3/026; B61L 3/006; B61L 17/00; B61L 27/0027

USPC ..... 701/19, 20, 400; 340/682, 991

See application file for complete search history.

(56) References Cited

U.S. PATENT DOCUMENTS

| | | | | |
|---|---|---|---|---|
| 5,332,180 | A | 7/1994 | Peterson et al. | |
| 5,740,547 | A | 4/1998 | Kull et al. | |
| 5,893,043 | A | 4/1999 | Mochlenbrink et al. | |
| 5,986,547 | A | 11/1999 | Korver et al. | |
| 6,498,969 | B2 | 12/2002 | Alacoque et al. | |
| 6,641,090 | B2 | 11/2003 | Meyer | |
| 7,209,810 | B2 | 4/2007 | Meyer et al. | |
| 7,650,207 | B2 | 1/2010 | Metzger | |
| 8,124,601 | B2 | 2/2012 | Kapp et al. | |
| 8,170,732 | B2 | 5/2012 | Daum et al. | |
| 8,214,091 | B2 | 7/2012 | Kernwein | |
| 8,483,893 | B2 | 7/2013 | Karg | |
| 8,494,695 | B2 * | 7/2013 | Cooper | H04L 67/14 104/88.01 |
| 9,126,608 | B2 * | 9/2015 | Kapp | B61L 3/006 |
| 9,296,402 | B2 * | 3/2016 | Backes | B61L 23/10 |
| 9,354,034 | B2 * | 5/2016 | Lundquist | G01B 7/003 |
| 2012/0303187 | A1 | 11/2012 | Sexauer et al. | |
| 2013/0090849 | A1 | 4/2013 | Uetake | |

OTHER PUBLICATIONS

Broquetas et al., "Track Detection in Railway Sidings Based on MEMS Gyroscope Sensors," Sensors, 2012, pp. 16228-16249, vol. 12.

* cited by examiner

*Primary Examiner* — Dalena Tran

(74) *Attorney, Agent, or Firm* — The Webb Law Firm

(57) ABSTRACT

A navigation system for a train having at least one locomotive or control car and, optionally, at least one railroad car, operating in a track network, wherein an on-board computer determines or receives location data and communicates or causes the communication of the location data and/or railway data to another locomotive or control car, another train, a remote server, or the like. A train navigation method is also provided.

42 Claims, 3 Drawing Sheets

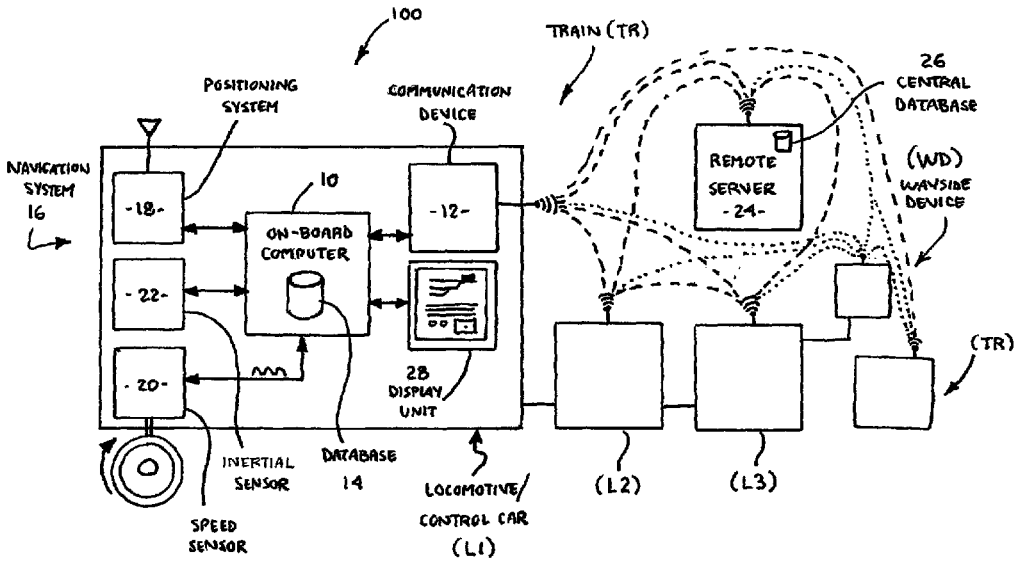
Fig. 1
Fig. 2
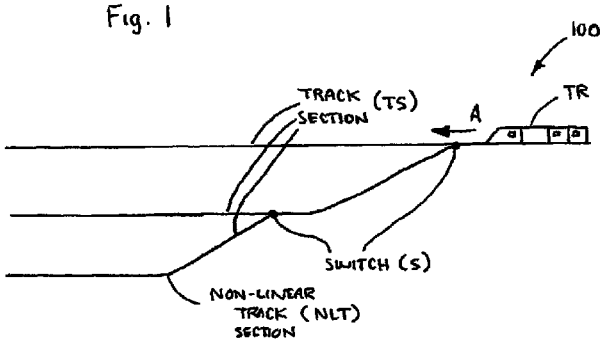
Fig. 3
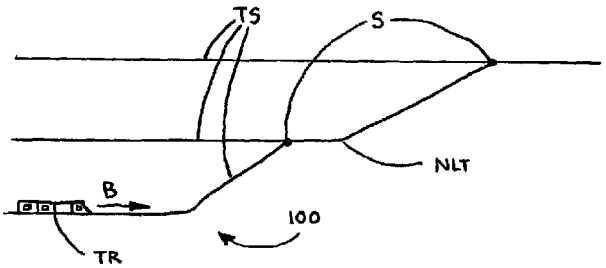

TRAIN NAVIGATION SYSTEM AND METHOD

BACKGROUND OF THE INVENTION

Field of the Invention

This invention relates generally to vehicle systems and navigation processes, such as railway systems including trains travelling in a track or rail network, and in particular to a train navigation system and method that provide improved navigation in railway networks, such as in connection with push-pull train configurations, commuter train applications, and the like.

Description of Related Art

Vehicle systems and networks exist throughout the world, and, at any point in time, a multitude of vehicles, such as cars, trucks, buses, trains, and the like, are travelling throughout the system and network. With specific reference to trains travelling in a track network, the locomotives of such trains are typically equipped with or operated using train control, communication, and management systems (e.g., positive train control (PTC) systems), such as the I-ETMS® of Wabtec Corp. In order to effectively manage all of the trains, navigation systems and processes are implemented, both at the train level and the central dispatch level. For example, many PTC systems rely on navigation systems and processes to determine on which track the train is operating, and to determine where the train will be operating in its route ahead. Such navigation generally relates to two modes, i.e., initial location determination and route navigation.

With respect to the difficulties in initial location determination, there are existing methods and arrangements that are in use, such as transponders on one or more of the railroad cars (or the locomotives) of the train, track circuits, forward-looking vehicle cameras, and/or crew interaction. With the exception of crew interaction, the remaining methods and arrangements require the installation and use of additional hardware that is relatively costly and requires ongoing maintenance. Although crew interaction does not require additional hardware (beyond the typically-installed cab interface in PTC systems), there remains the undesired aspect of relying on human input in a safety critical system. In existing PTC systems, the need for initial location determination occurs whenever a system is initialized, and in push-pull commuter operations where initialization would occur each time the crew swapped cabs to run in the other direction. The frequency of need for determining initial location, and the drawbacks of cost or potential for error with existing systems, warrant the need from an improved method and system.

With respect to the difficulties in route navigation, there exist certain methods and arrangements that are in use, e.g., transponders, switch position monitors, GPS path tracking, and/or crew interaction. For predictive enforcement of conditions ahead of the train, the use of a switch position monitoring method is beneficial since it permits the PTC system to determine where the train will be prior to traversing a switch with a diverging route. There are, however, other cases where predictive enforcement is not required, but determination of the route being taken is still desirable. For example, such a case arises in relation to the operation in passenger terminal areas that are excluded from compliance with PTC requirements. Such terminal areas often have multiple parallel tracks with numerous switches. A further challenge in these areas relates to the fact that the GPS path tracking may prove unreliable due to building obstructions or underground operation. Equipping all switches in a terminal area with tracking functionality would be costly, as would the installation of transponder equipment. Further, GPS tracking would be unreliable, and crew interaction is undesirable (as discussed above) due to the workload on the crew to make selections, and the large number of switches that are normally traversed in a large terminal area. For at least these reasons, there is a need in the art for an improved route navigation method and system.

SUMMARY OF THE INVENTION

Generally, provided are an improved train navigation system and computer-implemented method for use in connection with trains travelling in a track network. Preferably, provided are a train navigation system and computer-implemented method that provide an improved and accurate initial location determination for a train, or the railroad cars or locomotives that constitute the train. Preferably, provided are train navigation system and computer-implemented method that provide an improved and accurate process for route navigation for a train travelling in a track network. Preferably, provided are an improved train navigation system and computer-implemented method that are useful in connection with or in commuter train operations, freight train operations, push-pull train configurations, terminal areas, non-PTC track networks, and the like.

In one preferred and non-limiting embodiment or aspect, provided is a navigation system for a train having at least one locomotive or control car and, optionally, at least one railroad car, operating in a track network, the system comprising: on the at least one locomotive or control car: (i) an on-board computer programmed or configured to implement or facilitate at least one train action; (ii) a communication device in communication with the on-board computer and programmed or configured to receive, transmit, and/or process data signals; and (iii) at least one database in communication with the on-board computer with railway data stored therein; wherein the on-board computer of the at least one locomotive or control car is programmed or configured to: (a) determine or receive location data representing at least one of the following: the location or position of the train in the track network, the location or position of the at least one locomotive or control car in the track network, or any combination thereof; and (b) communicate or cause the communication of at least a portion of the location data and/or railway data to at least one of the following: at least one other locomotive or control car of the train, at least one other train operating in the track network, at least one remote server, a central controller, a central dispatch server, a switch, a wayside device, a wayside interface unit, a signal device, or any combination thereof.

In one preferred and non-limiting embodiment or aspect, the on-board computer of the at least one locomotive or control car is programmed or configured to communicate at least a portion of the railway data to at least one other locomotive or control car in the train. The railway data may comprise at least one of the following: consist data, position data, locomotive or control car data, railroad car data, identification data, length data, weight data, track data, or any combination thereof. The on-board computer of the at least one locomotive or control car may be programmed or configured to: receive location data from the at least one second locomotive or control car; and based at least partially on the received location data and the railway data, determine the intended or actual direction of travel of the train. The on-board computer of the at least one locomotive or control car may be programmed or configured to: receive location data from the at least one second locomotive or control car; and based at least partially on the received location data and the railway data, validate at least a portion of the railway data. The railway data that is validated may comprise at least one of the following: consist data, position data, locomotive or control car data, railroad car data, identification data, length data, weight data, track data, or any combination thereof.

In one preferred and non-limiting embodiment or aspect, step (a) comprises at least one of the following: (i) determining at least a portion of the location data based at least partially on railway data in the at least one database; (ii) determining at least a portion of the location data based at least partially on data received from at least one of the following: at least one other locomotive or control car of the train, at least one other train operating in the track network, at least one remote server, a central controller, a central dispatch server, a switch, a wayside device, a wayside interface unit, a signal device, or any combination thereof; (iii) determining at least a portion of the location data based at least partially on route data in the at least one database; (iv) determining at least a portion of the location data based at least partially on data input by or at least partially derived from input by at least one user; (v) determining at least a portion of the location data based at least partially on inertial sensor data in the at least one database; (vi) receiving at least a portion of the location data from at least one of the following: at least one other locomotive or control car of the train, at least one other train operating in the track network, at least one remote server, a central controller, a central dispatch server, a switch, a wayside device, a wayside interface unit, or any combination thereof; or any combination thereof.

In one preferred and non-limiting embodiment or aspect, the train comprises a first locomotive or control car having an on-board computer and at least one second locomotive or control car having an on-board computer, and wherein step (b) comprises communicating or causing the communication of at least a portion of the location data and/or at least a portion of the railway data from the first locomotive or control car to the at least one second locomotive or control car. The location data may comprise or may be at least partially derived from at least one of the following: track data; route data; signal data; switch data; switch alignment data; railway data; sensor data; transponder data; track circuit data; vehicle camera data; crew input; switch position monitor data; positioning system data; sensor data, inertial sensor data; switch alignment data based at least partially on direct or indirect communication with at least one of the following: a switch, a wayside device, a wayside interface unit, a signal device, or any combination thereof; switch alignment data based at least partially on direct or indirect user input; or any combination thereof. An on-board computer of the at least one second locomotive or control car may be programmed or configured to: determine location data based at least partially on the received location data and/or the received railway data; and based at least partially on the determined location data, at least one of: generate at least one independent navigation solution for the at least one train; determine route data for the at least one second locomotive or control car as a locomotive or control car in a train traversing the track in a second direction; verify at least a portion of the location data determined by the first locomotive or control car, or any combination thereof. At least a portion of the location data may be communicated to the at least one second locomotive or control car on at least one of the following bases: periodically, at a specified time, at a specified location, prior to traversing at least one switch, after traversing at least one switch, prior to stopping the train, after stopping the train, prior to initialization of an on-board computer of at least one locomotive or control car, after initialization of an on-board computer of at least one locomotive or control car, or any combination thereof. Prior to traversing the track in a second direction, an on-board computer of at least one of the locomotives or control cars may be further programmed or configured to determine that at least one of the first locomotive or control car or the at least one second locomotive or control car is in a controlling state. The determination may be based at least partially on at least one of the following: power data, power interruption data, monitoring data, movement data, wheel data, tachometer data, or any combination thereof.

In one preferred and non-limiting embodiment or aspect, the on-board computer of at least one of the locomotives or control cars of the train is programmed or configured to automatically determine the intended or actual direction of travel of the train based at least partially on at least one of the following: location data, route data, railway data, consist data, length data, weight data, car number data, train data, railroad car data, locomotive or control car data, locomotive or control car position data, railroad car position data, or any combination thereof. The determination may comprise: identifying at least one of the locomotives or control cars of the train as the lead locomotive or control car of the train; receiving location data from at least one other locomotive or control car of the train; and at least partially based on at least a portion of the railway data, which comprises consist data, and relative position with respect to the lead locomotive or control car, determining the intended or actual direction of travel. At least a portion of the location data generated by the at least one other locomotive or control car may be at least partially derived from at least one positioning system of the at least one other locomotive or control car. The determination is may be further based at least partially on at least one of the following: a control status of at least one locomotive or control car, a control status of a lead locomotive or control car, a reverser position of at least one locomotive or control car, a reverser position of the lead locomotive or control car, an orientation of at least one locomotive or control car, an orientation of the lead locomotive or control car. The determination may be made prior to movement of the train.

In one preferred and non-limiting embodiment or aspect, while traversing the track in a second direction, the on-board computer of at least one of the locomotives or control cars is further programmed or configured to communicate with specified wayside devices based at least partially on route data derived at least partially from at least a portion of the location data.

In one preferred and non-limiting embodiment or aspect, the train comprises a first locomotive or control car having an on-board computer and at least one second locomotive or control car having an on-board computer, wherein the on-board computer of the at least one second locomotive or control car is programmed or configured to communicate or cause the communication of local location data to the first locomotive or control car, wherein the local location data represents the location of the at least one second locomotive or control car. At least a portion of the local location data may be determined by or at least partially derived from at least one positioning system located on the at least one second locomotive or control car. At least a portion of the local location data may be at least partially derived by track data in at least one database.

In one preferred and non-limiting embodiment or aspect, based at least partially on at least a portion of the railway data in at least one database of the first locomotive or control car, and at least a portion of the received local location data, the on-board computer of the first locomotive or control car is programmed or configured to validate at least a portion of the railway data, thereby generated validated railway data. The railway data may comprise train data, which includes at least one of the following: consist data, locomotive or control car data, identification data, parameter data, the position of the first locomotive or control car in the train, the position of the at least one second locomotive or control car in the train, the length of the train, the number of locomotives or control cars in the train, the number of railroad cars in the train, weight data, or any combination thereof. At least partially based on at least a portion of the validated railway data, the on-board computer of the first locomotive or control car may be programmed or configured to implement at least one of the following: a train braking process, an enforcement process, a train dynamic modelling process, a distributed power modelling process, or any combination thereof.

In one preferred and non-limiting embodiment or aspect, the communication device of the at least one locomotive or control car is or utilizes at least one of the following: a messaging service, a direct wired communication link, an Ethernet link, an electrically-controlled pneumatic braking system link, a wireless link, a peer-to-peer communication link, an indirect wireless link, or any combination thereof.

In one preferred and non-limiting embodiment or aspect, the train is at least one of the following: a commuter train, a freight train, a distributed power train, or any combination thereof.

In one preferred and non-limiting embodiment or aspect, the navigation system further comprises at least one inertial sensor programmed or configured to generate inertial data, wherein the on-board computer of the at least one locomotive or control car is further programmed or configured to determine at least a portion of the location data based at least partially on the inertial data. The at least one inertial sensor may comprise a rotational sensor.

In one preferred and non-limiting embodiment or aspect, provided is a navigation system for a train having at least one locomotive or control car, wherein the train is traversing a track with at least one non-linear track section and/or at least one switch for changing paths between track sections, the system comprising: on the at least one locomotive or control car: (i) an on-board computer programmed or configured to implement or facilitate at least one train action; (ii) a communication device in communication with the on-board computer and programmed or configured to receive, transmit, and/or process data signals; and (iii) at least one database in communication with the on-board computer with railway data stored therein; and at least one inertial sensor positioned on the at least one locomotive or control car or on at least one railroad car of the train, wherein the at least one inertial sensor is programmed or configured to generate inertial data; wherein the on-board computer of the at least one locomotive or control car is programmed or configured to: (a) after traversing the at least one non-linear track section and/or the at least one switch, generate route signature data based at least partially on at least a portion of the inertial data; and (b) cause at least a portion of the route signature data to be stored in the at least one database.

In one preferred and non-limiting embodiment or aspect, at least a portion of at least one of the following: the inertial data, the route signature data, or any combination thereof, is transmitted by the communication device. The route signature data may be determined as a plot of heading change as a function of position. The on-board computer of the at least one locomotive or control car may be further programmed or configured to determine a forward route for the train based at least partially on at least a portion of the route signature data. The determination may further comprise comparing at least a portion of the route signature data to at least a portion of the route signature data stored in the at least one database.

In one preferred and non-limiting embodiment or aspect, the railway data comprises track data, the on-board computer of the at least one locomotive or control car further programmed or configured to compare at least a portion of the route signature data to at least a portion of the track data. Based at least partially on the comparison, the on-board computer of the at least one locomotive or control car may be programmed or configured to identify a track section where the train is located. Based at least partially on the comparison, the on-board computer of the at least one locomotive or control car may be programmed or configured to determine a forward route for the train. Based at least partially on the comparison, the on-board computer of the at least one locomotive or control car may be programmed or configured to verify a previously-traversed route of the train. The comparison may comprise determining a best match between the route signature data and track data, including potential routes, in the at least one database. The comparison may further comprise determining or receiving location data from at least one positioning system.

In one preferred and non-limiting embodiment or aspect, provided is a computer-implemented navigation method for a train having at least one locomotive or control car and, optionally, at least one railroad car, operating in a track network, the method comprising: (a) determining or receiving location data representing at least one of the following: the location or position of the train in the track network, the location or position of the at least one locomotive or control car in the track network, or any combination thereof; and (b) communicating or causing the communication of at least a portion of the location data to at least one of the following: at least one other locomotive or control car of the train, at least one other train operating in the track network, at least one remote server, a central controller, a central dispatch server, a switch, a wayside device, a wayside interface unit, a signal device, or any combination thereof.

In one preferred and non-limiting embodiment or aspect, provided is a computer-implemented navigation system for a train having at least one locomotive or control car, wherein the train is traversing a track with at least one non-linear track section and/or at least one switch for changing paths between track sections, the method comprising: (a) positioning at least one inertial sensor on the at least one locomotive or control car or on at least one railroad car of the train, wherein the at least one inertial sensor is programmed or configured to generate inertial data; (b) after traversing the at least one non-linear track section and/or the at least one switch, generate route signature data based at least partially on at least a portion of the inertial data; and (c) causing at least a portion of the route signature data to be stored in the at least one database.

Further embodiments or aspects will not be described and set forth in the following numbered clauses:

Clause 1. A navigation system for a train having at least one locomotive or control car and, optionally, at least one railroad car, operating in a track network, the system comprising: on the at least one locomotive or control car: (i) an on-board computer programmed or configured to implement or facilitate at least one train action; (ii) a communication device in communication with the on-board computer and programmed or configured to receive, transmit, and/or process data signals; and (iii) at least one database in communication with the on-board computer with railway data stored therein; wherein the on-board computer of the at least one locomotive or control car is programmed or configured to: (a) determine or receive location data representing at least one of the following: the location or position of the train in the track network, the location or position of the at least one locomotive or control car in the track network, or any combination thereof; and (b) communicate or cause the communication of at least a portion of the location data and/or railway data to at least one of the following: at least one other locomotive or control car of the train, at least one other train operating in the track network, at least one remote server, a central controller, a central dispatch server, a switch, a wayside device, a wayside interface unit, a signal device, or any combination thereof.

Clause 2. The navigation system of clause 1, wherein, prior to step (a), the on-board computer of the at least one locomotive or control car is programmed or configured to communicate at least a portion of the railway data to at least one other locomotive or control car in the train.

Clause 3. The navigation system of clause 2, wherein the railway data comprises at least one of the following: consist data, position data, locomotive or control car data, railroad car data, identification data, length data, weight data, track data, or any combination thereof.

Clause 4. The navigation system of clauses 2 or 3, wherein the on-board computer of the at least one locomotive or control car is programmed or configured to: receive location data from the at least one second locomotive or control car; and based at least partially on the received location data and the railway data, determine the intended or actual direction of travel of the train.

Clause 5. The navigation system of any of clauses 2-4, wherein the on-board computer of the at least one locomotive or control car is programmed or configured to: receive location data from the at least one second locomotive or control car; and based at least partially on the received location data and the railway data, validate at least a portion of the railway data.

Clause 6. The navigation system of clause 5, wherein the railway data that is validated comprises at least one of the following: consist data, position data, locomotive or control car data, railroad car data, identification data, length data, weight data, track data, or any combination thereof.

Clause 7. The navigation system of any of clauses 1-6, wherein step (a) comprises at least one of the following: (i) determining at least a portion of the location data based at least partially on railway data in the at least one database; (ii) determining at least a portion of the location data based at least partially on data received from at least one of the following: at least one other locomotive or control car of the train, at least one other train operating in the track network, at least one remote server, a central controller, a central dispatch server, a switch, a wayside device, a wayside interface unit, a signal device, or any combination thereof; (iii) determining at least a portion of the location data based at least partially on route data in the at least one database; (iv) determining at least a portion of the location data based at least partially on data input by or at least partially derived from input by at least one user; (v) determining at least a portion of the location data based at least partially on inertial sensor data in the at least one database; (vi) receiving at least a portion of the location data from at least one of the following: at least one other locomotive or control car of the train, at least one other train operating in the track network, at least one remote server, a central controller, a central dispatch server, a switch, a wayside device, a wayside interface unit, or any combination thereof; or any combination thereof.

Clause 8. The navigation system of any of clauses 1-7, wherein the train comprises a first locomotive or control car having an on-board computer and at least one second locomotive or control car having an on-board computer, and wherein step (b) comprises communicating or causing the communication of at least a portion of the location data and/or at least a portion of the railway data from the first locomotive or control car to the at least one second locomotive or control car.

Clause 9. The navigation system of clause 8, wherein the location data comprises or is at least partially derived from at least one of the following: track data; route data; signal data; switch alignment data; railway data; sensor data; transponder data; track circuit data; vehicle camera data; crew input; switch position monitor data; positioning system data; sensor data, inertial sensor data; switch alignment data based at least partially on direct or indirect communication with at least one of the following: a switch, a wayside device, a wayside interface unit, a signal device, or any combination thereof; switch alignment data based at least partially on direct or indirect user input; or any combination thereof.

Clause 10. The navigation system of clauses 8 or 9, wherein an on-board computer of the at least one second locomotive or control car is programmed or configured to: determine location data based at least partially on the received location data and/or the received railway data; and based at least partially on the determined location data, at least one of: generate at least one independent navigation solution for the at least one train; determine route data for the at least one second locomotive or control car as a locomotive or control car in a train traversing the track in a second direction; verify at least a portion of the location data determined by the first locomotive or control car, or any combination thereof.

Clause 11. The navigation system of any of clauses 8-10, wherein at least a portion of the location data is communicated to the at least one second locomotive or control car on at least one of the following bases: periodically, at a specified time, at a specified location, prior to traversing at least one switch, after traversing at least one switch, prior to stopping the train, after stopping the train, prior to initialization of an on-board computer of at least one locomotive or control car, after initialization of an on-board computer of at least one locomotive or control car, or any combination thereof.

Clause 12. The navigation system of any of clauses 8-11, wherein, prior to traversing the track in a second direction, an on-board computer of at least one of the locomotives or control cars is further programmed or configured to determine that at least one of the first locomotive or control car or the at least one second locomotive or control car is in a controlling state.

Clause 13. The navigation system of clause 12, wherein the determination is based at least partially on at least one of the following: power data, power interruption data, monitoring data, movement data, wheel data, tachometer data, or any combination thereof.

Clause 14. The navigation system of any of clauses 1-13, wherein the on-board computer of at least one of the locomotives or control cars of the train is programmed or configured to automatically determine the intended or actual direction of travel of the train based at least partially on at least one of the following: location data, route data, signal data, railway data, consist data, length data, weight data, car number data, train data, railroad car data, locomotive or control car data, locomotive or control car position data, railroad car position data, or any combination thereof.

Clause 15. The navigation system of clause 14, wherein the determination comprises: identifying at least one of the locomotives or control cars of the train as the lead locomotive or control car of the train; receiving location data from at least one other locomotive or control car of the train; and at least partially based on at least a portion of the railway data, which comprises consist data, and relative position with respect to the lead locomotive or control car, determining the intended or actual direction of travel.

Clause 16. The navigation system of clauses 14 or 15, wherein at least a portion of the location data generated by the at least one other locomotive or control car is at least partially derived from at least one positioning system of the at least one other locomotive or control car.

Clause 17. The navigation system of any of clauses 14-16, wherein the determination is further based at least partially on at least one of the following: a control status of at least one locomotive or control car, a control status of a lead locomotive or control car, a reverser position of at least one locomotive or control car, a reverser position of the lead locomotive or control car, an orientation of at least one locomotive or control car, an orientation of the lead locomotive or control car.

Clause 18. The navigation system of clause 17, wherein the determination is made prior to movement of the train.

Clause 19. The navigation system of any of clauses 1-18, wherein, while traversing the track in a second direction, the on-board computer of at least one of the locomotives or control cars is further programmed or configured to communicate with specified wayside devices based at least partially on route data derived at least partially from at least a portion of the location data.

Clause 20. The navigation system of any of clauses 1-19, wherein the train comprises a first locomotive or control car having an on-board computer and at least one second locomotive or control car having an on-board computer, wherein the on-board computer of the at least one second locomotive or control car is programmed or configured to communicate or cause the communication of local location data to the first locomotive or control car, wherein the local location data represents the location of the at least one second locomotive or control car.

Clause 21. The navigation system of clause 20, wherein at least a portion of the local location data is determined by or at least partially derived from at least one positioning system located on the at least one second locomotive or control car.

Clause 22. The navigation system of clauses 20 or 21, wherein at least a portion of the local location data is at least partially derived by track data in at least one database.

Clause 23. The navigation system of any of clauses 20-22, based at least partially on at least a portion of the railway data in at least one database of the first locomotive or control car, and at least a portion of the received local location data, the on-board computer of the first locomotive or control car is programmed or configured to validate at least a portion of the railway data, thereby generated validated railway data.

Clause 24. The navigation system of clause 23, wherein the railway data comprises train data, which includes at least one of the following: consist data, locomotive or control car data, identification data, parameter data, the position of the first locomotive or control car in the train, the position of the at least one second locomotive or control car in the train, the length of the train, the number of locomotives or control cars in the train, the number of railroad cars in the train, weight data, or any combination thereof.

Clause 25. The navigation system of clauses 23 or 24, wherein, at least partially based on at least a portion of the validated railway data, the on-board computer of the first locomotive or control car is programmed or configured to implement at least one of the following: a train braking process, an enforcement process, a train dynamic modelling process, a distributed power modelling process, or any combination thereof.

Clause 26. The navigation system of any of clauses 1-25, wherein the communication device of the at least one locomotive or control car is or utilizes at least one of the following: a messaging service, a direct wired communication link, an Ethernet link, an electrically-controlled pneumatic braking system link, a wireless link, a peer-to-peer communication link, an indirect wireless link, or any combination thereof.

Clause 27. The navigation system of any of clauses 1-26, wherein the train is at least one of the following: a commuter train, a freight train, a distributed power train, or any combination thereof.

Clause 28. The navigation system of any of clauses 1-27, further comprising at least one inertial sensor programmed or configured to generate inertial data, wherein the on-board computer of the at least one locomotive or control car is further programmed or configured to determine at least a portion of the location data based at least partially on the inertial data.

Clause 29. The navigation system of clause 28, wherein the at least one inertial sensor comprises a rotational sensor.

Clause 30. A navigation system for a train having at least one locomotive or control car, wherein the train is traversing a track with at least one non-linear track section and/or at least one switch for changing paths between track sections, the system comprising: on the at least one locomotive or control car: (i) an on-board computer programmed or configured to implement or facilitate at least one train action; (ii) a communication device in communication with the on-board computer and programmed or configured to receive, transmit, and/or process data signals; and (iii) at least one database in communication with the on-board computer with railway data stored therein; and at least one inertial sensor positioned on the at least one locomotive or control car or on at least one railroad car of the train, wherein the at least one inertial sensor is programmed or configured to generate inertial data; wherein the on-board computer of the at least one locomotive or control car is programmed or configured to: (a) after traversing the at least one non-linear track section and/or the at least one switch, generate route signature data based at least partially on at least a portion of the inertial data; and (b) cause at least a portion of the route signature data to be stored in the at least one database.

Clause 31. The navigation system of clause 30, wherein at least a portion of at least one of the following: the inertial data, the route signature data, or any combination thereof, is transmitted by the communication device.

Clause 32. The navigation system of clauses 30 or 31, wherein the route signature data is determined as a plot of heading change as a function of position.

Clause 33. The navigation system of any of clauses 30-32, wherein the on-board computer of the at least one locomotive or control car is further programmed or configured to determine a forward route for the train based at least partially on at least a portion of the route signature data.

Clause 34. The navigation system of clause 33, wherein the determination further comprises comparing at least a portion of the route signature data to at least a portion of the route signature data stored in the at least one database.

Clause 35. The navigation system of any of clauses 30-34, wherein the railway data comprises track data, the on-board computer of the at least one locomotive or control car further programmed or configured to compare at least a portion of the route signature data to at least a portion of the track data.

Clause 36. The navigation system of clause 35, wherein, based at least partially on the comparison, the on-board computer of the at least one locomotive or control car is programmed or configured to identify a track section where the train is located.

Clause 37. The navigation system of clauses 35 or 36, wherein, based at least partially on the comparison, the on-board computer of the at least one locomotive or control car is programmed or configured to determine a forward route for the train.

Clause 38. The navigation system of any of clauses 35-37, wherein, based at least partially on the comparison, the on-board computer of the at least one locomotive or control car is programmed or configured to verify a previously-traversed route of the train.

Clause 39. The navigation system of any of clauses 35-37, wherein the comparison comprises determining a best match between the route signature data and track data, including potential routes, in the at least one database.

Clause 40. The navigation system of any of clauses 35-39, wherein the comparison further comprises determining or receiving location data from at least one positioning system.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

FIG. 1 is a schematic view of one embodiment of a train navigation system according to the principles of the present invention;

FIG. 2 is a schematic view of another embodiment of a train navigation system according to the principles of the present invention;

FIG. 3 is a schematic view of another embodiment of a train navigation system according to the principles of the present invention;

DETAILED DESCRIPTION OF THE PREFERRED EMBODIMENTS

Figure 4:
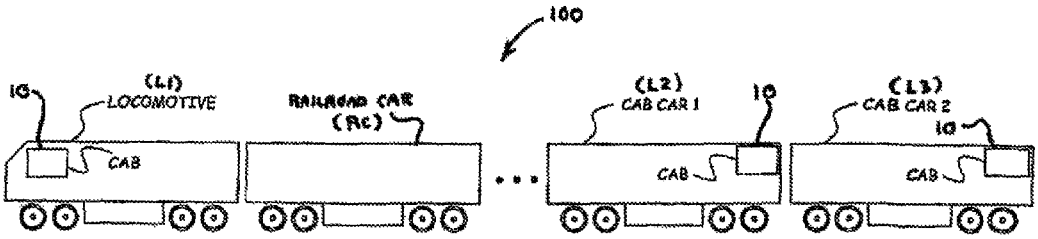
FIG. 4 is schematic view of a further embodiment of a train navigation system according to the principles of the present invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. It is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

As used herein, the terms "communication" and "communicate" refer to the receipt, transmission, or transfer of one or more signals, messages, commands, or other type of data. For one unit or device to be in communication with another unit or device means that the one unit or device is able to receive data from and/or transmit data to the other unit or device. A communication may use a direct or indirect connection, and may be wired and/or wireless in nature. Additionally, two units or devices may be in communication with each other even though the data transmitted may be modified, processed, routed, etc., between the first and second unit or device. For example, a first unit may be in communication with a second unit even though the first unit passively receives data, and does not actively transmit data to the second unit. As another example, a first unit may be in communication with a second unit if an intermediary unit processes data from one unit and transmits processed data to the second unit. It will be appreciated that numerous other arrangements are possible. Any known electronic communication protocols and/or algorithms may be used such as, for example, TCP/IP (including HTTP and other protocols), WLAN (including 802.11 and other radio frequency-based protocols and methods), analog transmissions, and/or the like. It is to be noted that a "communication device" includes any device that facilitates communication (whether wirelessly or hard-wired (e.g., over the rails of a track)) between two units, such as two locomotive units or control cars. In one preferred and non-limiting embodiment, the "communication device" is a radio transceiver programmed, configured, or adapted to wirelessly transmit and receive radio frequency signals and data over a radio signal communication path.

The navigation system and computer-implemented communication method described and claimed herein may be implemented in a variety of systems and vehicular networks; however, the systems and methods described herein are particularly useful in connection with a railway system and network. Accordingly, the presently-invented methods and systems can be implemented in various known train control and management systems, e.g., the I-ETMS® of Wabtec Corp. The systems and methods described herein are useful in connection with and/or at least partially implemented on one or more locomotives or control cars (L) that make up a train (TR), such as a train (TR) in a "push-pull" arrangement. It should be noted that multiple locomotives or control cars (L) may be included in the train (TR) to facilitate the reduction of the train (TR) to match with passenger (or some other) demand or requirement. Further, the method and systems described herein can be used in connection with commuter trains, freight train, and/or other train arrangements and systems. Still further, the train (TR) may be separated into different configurations (e.g., other trains (TR)) and moved in either the first direction A and/or the second direction B. Any configuration or arrangement of locomotives, control cars, and/or railroad cars may be designated as a train and/or a consist. Still further, it is to be expressly understood that the presently-invented methods and systems described herein may be implemented on and/or used in connection with an auxiliary vehicle, such as an auxiliary railroad vehicle, a maintenance vehicle or machine, a road vehicle (e.g., truck, pick-up truck, car, or other machine), a vehicle equipped to ride on the rails of the track, and/or the like.

In one preferred and non-limiting embodiment, the methods and systems described herein are used in connection with the locomotives or controls cars (L) that are positioned on each end of the train (TR), while in other preferred and non-limiting embodiments, the methods and systems described herein are used in connection with locomotives or control cars (L) that are positioned intermediately in the train (TR) (since these intermediate locomotives or control cars (L) may eventually becoming a controlling locomotive or control car (L) when the train (TR) is reconfigured). It is also noted that the methods and systems described herein may be used in connection with "electrical multiple unit" (EMU) or "diesel multiple unit" (DMU) configurations, where a locomotive does not technically exist, but multiple control cars would still be present. Still further, the train (TR) may include only one locomotive or control car (L) and/or some or no railroad cars. Also, as discussed above, the methods and systems described herein may be used in connection with any vehicle type operating in the railway network.

Accordingly, and in one preferred and non-limiting embodiment, and as illustrated in FIG. 1, the system architecture used to support the functionality of at least some of the methods and systems described herein includes a train management computer or on-board computer 10 (which performs calculations for or within the Positive Train Control (PTC) system, including navigation calculations), a communication device 12 or data radio (which may be used to facilitate the communications between the on-board computers 10 in one or more of the locomotives or control cars (L) of a train (TR), communications with a wayside device, e.g., signals, switch monitors, and the like, and/or communications with a remote server, e.g., a back office server, a central controller, central dispatch, and/or), a track database 14 (which may include track and/or train information and data, such as information about track positions or locations, switch locations or information, signal information, track heading changes, e.g., curves, distance measurements, train information, e.g., the number of locomotives, the number of cars, the number of conventional passenger cars, the number of control cars, the total length of the train, the specific identification numbers of each locomotive or control car (L) where PTC equipment (e.g., an on-board computer 10) is located, and the like), and a navigation system 16 (optionally including a positioning system 18 (e.g., a Global Positioning System (GPS)), a wheel tachometer/speed sensor 20, and/or at least one inertial sensor 22 (e.g., a rotational sensor, an accelerometer, a gyroscope, and the like) that is configured to measure the rate of heading change for the locomotive or control car (L), such as a PTC-equipped locomotive or control car (L)). Further, a display unit 28 may be provided in the locomotive or control car (L) to visually display information and data to the operator, as well as display information and data input by the user.

Figure 5:
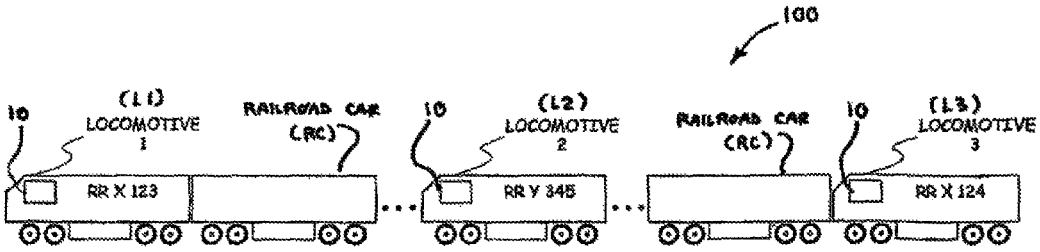
FIG. 5 is a schematic view of a still further embodiment of a train navigation system according to the principles of the present invention.

Accordingly, and in one preferred and non-limiting embodiment, provided is a navigation system 100 for a train (TR) having at least one locomotive (L), such as a first locomotive or control car (L1) and at least one second locomotive or control car ((L2), (L3)). Optionally, the train (TR) may include one or more railroad cars (RC), as illustrated in the embodiment of FIGS. 4 and 5. In one embodiment, the train (TR) is traversing a track section (TS), which may include at least one non-linear track section (NLT) and/or at least one switch (S) for changing paths between track sections (TS). An on-board computer 10 is positioned on or integrated with one or more of the locomotives or control cars ((L1), (L2), and/or (L2)), and the on-board computer 10 is programmed or configured to implement or facilitate at least one train action. Further, the one or more locomotives or control cars ((L1), (L2), and/or (L2)) are equipped with a communication device 12 that is in direct or indirect communication with the on-board computer 10 and programmed or configured to receive, transmit, and/or process data signals. At least one database 14 (e.g., a track database) is accessible by the on-board computer 10 and populated with railway data, such as train data or track data or information. It should be noted that the non-linear track section (NLT) may be non-linear in a lateral direction (i.e., a left-bend, a right-bend, etc.) or an elevational direction (i.e., an upward grade, a downward grade, etc.).

With continued reference to this preferred and non-limiting embodiment, as well as with further reference to FIGS. 2 and 3, the on-board computer 10 of the at least one locomotive (e.g., the on-board computer 10 of at least one of the locomotives or control cars ((L1), (L2), and/or (L3))) is programmed or configured to: determine or receive location data that includes or represents at least one of the following: the location or position of the train (TR) in the track network, the location or position of the at least one locomotive or control car (L) in the track network, or any combination thereof. Further, the on-board computer 10 is programmed or configured to communicate or cause the communication of (such as using the communication device 12) at least a portion of the location data and/or railway data to at least one of the following: at least one other locomotive or control car ((L1), (L2), and/or (L3)) of the train (TR), at least one other train (TR) operating in the track network, at least one remote server 24, a central controller, a central dispatch server, a switch (S), a wayside device (WD), a wayside interface unit, a signal device, or any combination thereof.

In one preferred and non-limiting embodiment, and prior to step (a), the on-board computer 10 of the first locomotive or control car (L1) is programmed or configured to communicate or cause the communication of at least a portion of the railway data (e.g., the train or track information or data, which may be stored in the database 14) to at least one other locomotive or control car ((L2) and/or (L3)) of the train (TR). This facilitates the distribution of important or specified train and/or track information and data between locomotives or control cars ((L1), (L2), and/or (L3)) of the same train (TR). However, as discussed above, any of the location data and/or the railway data may be transmitted or communicated to a variety of other devices and systems.

In another preferred and non-limiting embodiment, and as discussed hereinafter, while traversing the track (e.g., one or more track sections (TS)) in a first direction (e.g., direction A), determine or generate route data including or representing at least one of the following: the presence of at least one upcoming switch (S), the presence of at least one upcoming non-linear track section (NLT), an alignment of at least one switch (S), an identification of a track section (TS) after traversing at least one switch (S), an identification of a track section (TS) after traversing at least one non-linear track section (NLT), or any combination thereof. Additionally, in this embodiment, the on-board computer 10 is programmed or configured to: cause at least a portion of the route data to be stored in the at least one database 14; and communicate or cause the communication of at least a portion of the route data and/or railway data to at least one other on-board computer 10 of at least one other locomotive or control car ((L1), (L2), and/or (L3)). In this embodiment, the on-board computer 10 of the at least one other locomotive or control car ((L1), (L2), and/or (L3)) uses at least a portion of the stored route data while traversing the track (e.g., one or more track sections (TS)) in a second direction (e.g., direction B). In another preferred and non-limiting embodiment, each of the locomotives or control cars ((L1), (L2), and/or (L3)) of the train (TR) include the on-board computer 10, the communication device 12, and/or the database 14.

In another preferred and non-limiting embodiment, the communication device 12 of the locomotive or control car (L) is or utilizes at least one of the following: a messaging service, a direct-wired communication link, an Ethernet link, an electrically-controlled pneumatic braking system link, a wireless link, a peer-to-peer communication link, an indirect wireless link, or any combination thereof. Accordingly, the railway data and/or the location data (e.g., route data) can be transmitted and/or communicated between the locomotives or control cars ((L1), (L2), and/or (L3)) in any effective or redundant manner.

In a further preferred and non-limiting embodiment, and as discussed, at least a portion of the location data and/or railway data is directly or indirectly transmitted to and received by at least one of the following: the remote server 24 (e.g., a central controller, a central dispatch server, and the like), a wayside device (WD) (e.g., a wayside interface unit), or any combination thereof. Further, at least a portion of the received location data and/or railway data may be populated in or stored in at least one central database 26, such as a remote database accessible by or through the remote server 24. Accordingly, the location data and/or railway data is accessible throughout and useful within the track network by any connected or communicative locomotive or control car of any travelling train (or other vehicle) for navigational or other purposes.

In another preferred and non-limiting embodiment, the railway data that is populated or stored in the at least one database 14 includes or is the form of at least one of the following: consist data (e.g., information or data associated with the consist or train (TR)), position data (e.g., the position of any locomotive, control car, and/or railroad car in the train (TR)), locomotive or control car data (e.g., specific information or data about the locomotive or control car ((L1), (L2), and/or (L3)) in the train (TR)), railroad car data (e.g., specific information or data about any of the railroad cars (RC) in the train (TR)), identification data (e.g., identifying information about any of the cars or portions of the train (TR)), length data (e.g., the length of the entirety or any portion of the train (TR)), weight data (e.g., the weight of the entirety or any portion of the train (TR)), track data (e.g., information or data associated with the track, track sections (TS), wayside devices (WD), switches (S), signal devices, or any other equipment or features associated with the track or track network)), or any combination thereof.

In one preferred and non-limiting embodiment, the on-board computer 10 of the first locomotive or control car (L1) receives location data (and/or railway data) from the at least one second locomotive or control car ((L1) and/or (L2)). Based at least partially on this received information or data, the on-board computer 10 determines the intended or actual direction of travel of the train (TR). For example, and based upon the location data and/or railway data, such as the positions of the locomotives or control cars ((L1), (L2), and/or (L3)) in the train, the actual or intended direction of travel may be established or determined. In this exemplary embodiment, and using the location data and/or the railway data, such as information or data from position reports provided by and between the locomotives or control cars ((L1), (L2), and/or (L3)), the on-board computer 10 can determine which way the train (TR) is pointing. By making this determination prior to the train (TR) moving, enforcement action may be taken immediately upon movement if the train (TR) is moving in an unauthorized direction on the track section (TS). This also provides the on-board computer 10 with additional time to detect and/or obtain the statuses of upcoming switches (S), signals, wayside devices (WD), and the like.

In another preferred and non-limiting embodiment, the on-board computer 10 of the locomotive or control car (L) (e.g., the first locomotive or control car (L1)) is programmed or configured to receive location data (and/or railway data) from the at least one second locomotive or control car ((L2) and/or (L3)), and based at least partially on the received location data and the railway data, validate at least a portion of the railway data. In this embodiment, the railway data that is validated may include at least one of the following: consist data (e.g., information or data associated with the train (TR), position data (e.g., the position of any car or portion of the train (TR)), locomotive or control car data (e.g., the position of the various locomotives or control cars (L) in the train (TR)), railroad car data (e.g., the position of the various railroad cars (RC) in the train (TR)), identification data (e.g., the specific identification of any of the cars or portions of the train (TR)), length data (e.g., the length of the entirety or any portion of the train (TR)), weight data (e.g., the weight of the entirety or any portion of the train (TR)), track data (e.g., information or data associated with the track, track sections (TS), wayside devices (WD), switches (S), signal devices, or any other equipment or features associated with the track or track network), or any combination thereof. In one example, and with each locomotive or control car (L) reporting its position in the train (TR), the on-board computer 10 can use the location data and/or the railway data to confirm that each specific locomotive or control car (L) is correctly indicated in the provided consist. In addition, this information and data, including the validation process, can be used in connection with braking or enforcement process implementation, modelling of the dynamics of the train (TR), and other train control actions.

In one preferred and non-limiting embodiment, the on-board computer 10 is programmed or configured to: determine at least a portion of the location data based at least partially on railway data in the database 14 (e.g., determination location data based upon existing information and data populated in the database 14 either at train initialization or during operation, position system data or systems, other equipment associated with the train (TR), etc.); determine at least a portion of the location data based upon received data (e.g., information or data received from another locomotive or control car (L), another train (TR), the remote server 24, a switch (S), a wayside device (WD), a signal device, etc.); determine at least a portion of the location data based upon route data (e.g., information or data regarding the previously-travelled and/or intended (upcoming) route of the train (TR)); determine at least a portion of the location data based upon or derived from user input (e.g., information that is input to the on-board computer 10 by the operator before, during, or after the trip); determine at least a portion of the location information based upon inertial sensor data (e.g., data or information obtained or derived from one or more outputs from at least one inertial sensor 22); or receiving location data directly or indirectly from some other locomotive or control car (L), train (TR), a remote server 24, a switch (S), a wayside device (WD), a signal device, and/or the like.

In one preferred and non-limiting embodiment, the train (TR) includes the first locomotive or control car (L1) and at least one second locomotive or control car ((L2) and/or (L3)), where a communication link is established between the first locomotive or control car (L1) and the at least one second locomotive or control car ((L2) and/or (L3)). At least a portion of the location data and/or the railway data is transmitted from the first locomotive or control car (L1) to the at least one second locomotive or control car ((L2) and/or (L3)) (i.e., the on-board computer of the at least one second locomotive or control car ((L2) and/or (L3))). As discussed above, the location data may include, be derived from, or represent a variety of data points and information, such as at least one of the following: track data; route data; signal data; switch alignment data; railway data; sensor data; transponder data; track circuit data; vehicle camera data; crew input; switch position monitor data; positioning system data; sensor data, inertial sensor data; switch alignment data based at least partially on direct or indirect communication with at least one of the following: a switch, a wayside device, a wayside interface unit, a signal device, or any combination thereof; switch alignment data based at least partially on direct or indirect user input; or any combination thereof.

In another preferred and non-limiting embodiment, the on-board computer 10 of the at least one second locomotive or control car ((L2) and/or (L3)) is programmed or configured to determine location data based upon at least partially on the received location data and/or the received railway data; and based at least partially upon the determined location data, implement at least one of the following: generate at least one independent navigation solutions for the train (TR), which represents a separate and distinct navigation solutions for the train (TR) in either direction A or B; determine route data, e.g., an intended or forward route, for the train (TR) traversing in the second direction B; verify and/or validate at least a portion of the location data (and/or the railway data) that was determined by the first locomotive or control car (L1), or any combination thereof. Further, in this embodiment, at least a portion of the location data is communicated to the at least one second locomotive or control car ((L2) and/or (L3)) on at least one of the following bases: periodically (e.g., automatically at set periods of time), at a specified time, at a specified location (e.g., when the train (TR) reaches a specific location), prior to traversing at least one switch (S), after traversing at least one switch (S), prior to stopping the train (TR) (e.g., during operation), after stopping the train (TR) (e.g., at the end of a trip), prior to initialization of an on-board computer 10 of at least one locomotive or control car (L), after initialization of an on-board computer 10 of at least one locomotive or control car (L), or any combination thereof.

In one preferred and non-limiting embodiment, and prior to traversing the track in the second direction B, the on-board computer 10 of at least one of the locomotives or control cars ((L1), (L2), and/or (L3)) is further programmed or configured to determine that at least one of the first locomotive or control car (L1) or the at least one second locomotive or control car ((L2) and/or (L3)) is in a controlling state. This determination will facilitate the forward route determination process, since it is the controlling locomotive or control car (L) that determines the direction of travel. Further, this facilitates the enforcement action and safety requirement that the train (TR) has not moved without at least one of the on-board computers 10 in the controlling state. In this embodiment, this determination may be based at least partially on at least one of the following: power data (e.g. data or information regarding the power to various components of the train (TR)), power interruption data, monitoring data, movement data (e.g., any data point or measurement that indicates movement of the train (TR) or any portion thereof), wheel data, tachometer data, or any combination thereof.

In another preferred and non-limiting embodiment, the on-board computer 10 of at least one of the locomotives or control cars ((L1), (L2), and/or (L3)) of the train (TR) is programmed or configured to automatically determine the intended or actual direction of travel of the train based at least partially on at least one of the following: location data, route data, signal data, railway data, consist data, length data, weight data, car number data, train data, railroad car data, locomotive or control car data, locomotive or control car position data, railroad car position data, or any combination thereof. This determination may include: identifying at least one of the locomotives or control cars ((L1), (L2), and/or (L3)) of the train (TR) as the lead locomotive or control car of the train; receiving location data (e.g., location in the track network) from at least one other locomotive or control car ((L1), (L2), and/or (L3)) of the train (TR); and at least partially based on at least a portion of the railway data, which includes or represents consist data, and relative position with respect to the lead locomotive or control car, determining the intended or actual direction of travel. In this embodiment, at least a portion of the location data generated by the at least one other locomotive or control car ((L1), (L2), and/or (L3)) may at least partially derived from at least one positioning system 18 (e.g., a GPS device/system) of the at least one other locomotive or control car ((L1), (L2), and/or (L3)). In this embodiment, this determination may be further based at least partially on at least one of the following: a control status of at least one locomotive or control car ((L1), (L2), and/or (L3)), a control status of a lead locomotive or control car ((L1), (L2), and/or (L3)), a reverser position of at least one locomotive or control car ((L1), (L2), and/or (L3)), a reverser position of the lead locomotive or control car ((L1), (L2), and/or (L3)), an orientation of at least one locomotive or control car ((L1), (L2), and/or (L3)) (i.e., which way the locomotive or control car is facing or pointing), an orientation of the lead locomotive or control car ((L1), (L2), and/or (L3)) (i.e., which way the lead locomotive or control car is facing or pointing). In this embodiment, this determination may be made prior to movement of the train (TR).

In one preferred and non-limiting embodiment, and while traversing the track in the second direction B, the on-board computer 10 of at least one of the locomotives or control cars (L) is further programmed or configured to communicate with specified wayside devices, such as switches (S), wayside interface units (WIUs), signal devices, etc., based at least partially on route data derived at least partially from at least a portion of the location data. This facilitates data and information to be distributed throughout the system for use in navigation decisions for both the originating train (TR) and other trains (TR) in the track network.

In another preferred and non-limiting embodiment, the train (TR) includes the first locomotive or control car (L1) and the at least one second locomotive or control car ((L2) and/or (L3)), where the on-board computer 10 of the at least one second locomotive or control car ((L2) and/or (L3)) is programmed or configured to communicate or cause the communication of local location data to the first locomotive or control car (L1). This local location data includes or represents the location of the at least one second locomotive or control car ((L2) and/or (L3)). In this embodiment, at least a portion of this local location data is determined by or at least partially derived from at least one positioning system 18 located on the at least one second locomotive or control car ((L2) and/or (L3)). At least a portion of this local location data may be at least partially derived by or from track data in the database 14, and based at least partially on at least a portion of the railway data in the database 14 of the first locomotive or control car (L1), and at least a portion of the received local location data, the on-board computer 10 of the first locomotive or control car (L1) is programmed or configured to validate at least a portion of the railway data (e.g., data or information about the consist, the train (TR), etc., thereby generated validated railway data. In this embodiment, railway data may include or represent train data, which includes at least one of the following: consist data, locomotive or control car data, identification data, parameter data, the position of the first locomotive or control car (L1) in the train (TR), the position of the at least one second locomotive or control car ((L2) and/or (L3)) in the train (TR), the length of all or a portion of the train (TR), the number of locomotives or control cars (L) in the train (TR), the number of railroad cars (RC) in the train (TR), weight data, or any combination thereof. Still further, and at least partially based on at least a portion of the validated railway data, the on-board computer 10 of the first locomotive or control car (L1) is programmed or configured to implement at least one of the following: a train braking process (e.g., a braking event to slow or stop the train (TR)), an enforcement process (e.g., a braking event, an alarm condition, etc.), a train dynamic modelling process (a modelling of one or more conditions or parameters behind or ahead of the train (TR)), a distributed power modelling process, or any combination thereof.

In one preferred and non-limiting embodiment, the train (TR) is at least one of the following: a commuter train, a freight train, a distributed power train, or any combination thereof. In another preferred and non-limiting embodiment, the system 100 includes at least one inertial sensor 22 programmed or configured to generate inertial data, and the on-board computer 10 of the at least one locomotive or control car (L) is further programmed or configured to determine at least a portion of the location data (and/or railway data) based at least partially on the inertial data. This inertial sensor 22 may take a variety of forms, such as a rotational sensor, a gyroscope, an accelerometer, and/or the like. Also, as discussed above, the inertial sensor 22 may be programmed or configured to output lateral movement data and/or grade related data.

In one preferred and non-limiting embodiment, the navigation system 100 is implemented for a train (TR) traversing a track with at least one non-linear track section (NLT) and/or at least one switch (S) for changing paths between track sections (TS). In this embodiment, the system 100 includes at least one inertial sensor 22 positioned on the at least one locomotive or control car (L) or on at least one railroad car (RC) of the train, and the at least one inertial sensor 22 is programmed or configured to generate inertial data. The on-board computer 10 is programmed or configured to: (a) after traversing the at least one non-linear track section (NLT) and/or the at least one switch (S), generate route signature data based at least partially on at least a portion of the inertial data; and (b) cause at least a portion of the route signature data to be stored in the database 14. At least a portion of at least one of the following: the inertial data, the route signature data, or any combination thereof, may be transmitted by the communication device 12. Further, the route signature data may be determined and/or visually displayed (e.g., on the display unit 28 or some remote display device) as a plot of heading change as a function of position. Further, and again, inertial data may include or represent lateral movement data and/or grade related data, all of which may be used to create or generate an accurate and unique signature for the track section (TS).

In one preferred and non-limiting embodiment, the on-board computer of the at least one locomotive or control car (L) is further programmed or configured to determine a forward route for the train (TR) based at least partially on at least a portion of the route signature data. For example, once the route signature data is established in the travelled route of the train (TR), and based at least partially upon the location data or known location or position of the train (TR) or some other train (TR) in the track network, this route signature data can be used to effectively navigate in the other direction (for the existing train (TR)) or in the same direction (for another train (TR) that includes the track section (TS) for which the route signature data is generated in its forward route. This determination may further include comparing at least a portion of the route signature data to at least a portion of the route signature data stored in the at least one database 14, which allows for validation of the route that the train (TR), or some other train (TR), is taking.

In one preferred and non-limiting embodiment, the railway data includes or represents track data, and the on-board computer 10 of the at least one locomotive or control car (L) is further programmed or configured to compare at least a portion of the route signature data to at least a portion of the track data. In this embodiment, and based at least partially on the comparison, the on-board computer 10 of the at least one locomotive or control car (L) may be programmed or configured to identify a track section (TS) where the train (TR) is located. Based at least partially on the comparison, the on-board computer 10 of the at least one locomotive or control car (L) may also be programmed or configured to determine a forward route for the train (TR), or some other train (TR). Based at least partially on the comparison, the on-board computer 10 of the at least one locomotive or control car (L) may be programmed or configured to verify a previously-traversed route of the train (TR). In one preferred and non-limiting embodiment, the comparison includes determining a best match between the route signature data and track data, including potential routes, in the database 14, and the comparison may further include determining or receiving location data from the positioning system 18. In one example, and after collecting information from multiple trains (TS) traversing the same track area, a library of route data and/or route signature data can be compiled. This would facilitate a fast and accurate "best match" process that would become more and more accurate as the library for that track area (e.g., those track sections (TS)) increases.

Further, and as discussed above, at least a portion of this inertial data may be in the form of or used to generate route signature data, which, in turn, will aid in train navigation. For example, as the train (TR) moves along the track section (TS) and travels along anon-linear track section (NLT) or goes through a switch (S), the inertial sensor 22 will sense the deflection or movement through the non-linear track section (NLT) or from one track section (TS) to another track section (TS). In this manner, the inertial data can be used (potentially along with the knowledge of the speed, position, and/or characteristics of the train (TS)) to indicate movement along the non-linear track section (NLT) and/or switching between track segments (TS), including the location or position of both the train (TR) and the non-linear track section (NLT) or the switch (S). This information can be used when the train (TR) or any other train (TR) is moving through same track sections (TS) in the first direction A and/or the second direction B.

In one preferred and non-limiting embodiment, provided is a computer-implemented navigation method for a train (TR) having at least one locomotive or control car (L) and, optionally, at least one railroad car (RC), operating in a track network, the method including: (a) determining or receiving location data representing at least one of the following: the location or position of the train (TR) in the track network, the location or position of the at least one locomotive or control car (L) in the track network, or any combination thereof; and (b) communicating or causing the communication of at least a portion of the location data to at least one of the following: at least one other locomotive or control car (L) of the train (TR), at least one other train (TR) operating in the track network, at least one remote server 24, a central controller, a central dispatch server, a switch (S), a wayside device (WD), a wayside interface unit, a signal device, or any combination thereof.

In another preferred and non-limiting embodiment, provided is a computer-implemented navigation system for a train (TR) having at least one locomotive or control car (L), wherein the train (TR) is traversing a track with at least one non-linear track section (NLT) and/or at least one switch (S) for changing paths between track sections (TS), the method including: (a) positioning at least one inertial sensor 22 on the at least one locomotive or control car (L) or on at least one railroad car (RC) of the train (TR), wherein the at least one inertial sensor 22 is programmed or configured to generate inertial data; (b) after traversing the at least one non-linear track section (NLT) and/or the at least one switch (S), generate route signature data based at least partially on at least a portion of the inertial data; and (c) causing at least a portion of the route signature data to be stored in the at least one database 14.

In one exemplary embodiment, and as illustrated in FIG. 4, the train (TR) is in the form of a push-pull train configuration, and the system 100 provides a valid navigation solution as the train (TR) ends its operation/trip in one direction, where that solution/process is used by the train equipment in the other end of the train (TR) as it starts the next trip (in the second direction). In this exemplary embodiment, the train (TR) is in a "pull" configuration with operation from the locomotive (L1). At initialization, the train data would indicate that the consist includes a first cab car (or control car) (L2) and a second cab car (or control car) (L3), and the identification information of each vehicle is available in the consist data. The identification information allows the locomotive (L1) to communicate with each cab car (or control car) ((L2) and (L3)) through a messaging service, which may be a direct wired link (e.g., Ethernet or ECP), wireless peer-to-peer communication, and/or wireless communication to a base station or office routing component.

At system initialization, the locomotive (L1) PTC system can communication (or share) the consist data with the cab car (or control car) ((L2) and (L3)) PTC systems, such that these systems can use this data to validate position report information from the locomotive (L1), and to positively determine that all of the vehicles identified in the consist data are actually in the train (TR) together. In the case of a direct wired communication link, the system 100 may also implement or perform a "self-discovery" process of all PTC systems in the train (TR).

With continued reference to this exemplary embodiment, as the locomotive (L1) travels down the track and encounters switches (S) (or non-linear track sections (NLT), the on-board computer 10 (via the communication device 12) may communicate (directly or indirectly) with the switches (S) and/or the wayside interface device to determine the route. Switches (S) that are not monitored may require crew input, or, as discussed above, the other inventive methods and processes of the present invention. While the locomotive (L1) continues to navigate, its on-board computer 10 continues to generate position reports for use by the cab cars (or control cars) ((L2) and/or (L3)) to maintain independent navigation solutions. These position reports may be sent periodically, as well as when the locomotive (L1) traversed a switch (S).

In this exemplary embodiment, and by maintaining a location solution in all vehicles, the PTC system can use that location when changing ends (i.e., changing directions). One benefit of this solution is that the train (TR) has not moved without at least one of the PTC systems in the controlling state. In addition, a check for this requirement may be made by confirming that no interruption in power has occurred, and/or by monitoring the speed sensor 20 for movement.

In another exemplary embodiment, the system 100 and method also provides for the train (TR) to automatically determine its direction of travel. With the knowledge of the locations of the locomotives and cab cars (or control cars) ((L1), (L2), and/or (L3)), together with the reverse position of the leading unit, the track database 14 can be utilized to determine the direction that the train (TR) will move along mapped track. This determination can be completed prior to the train (TR) moving, making the PTC enforcement available immediately upon movement of the train (TR). This also provides the PTC system with additional time to obtain the statuses of switches (S) and signals located in future route of the train (TR), allowing for smooth and safe movement. This functionality can be extended to freight services as well, where, rather than a cab car (or control car), an additional locomotive will be utilized.

In another exemplary embodiment, and with reference to FIG. 5, the system 100 provides a validation process for validating the consist of the train (TR), such as the locations of all of the locomotives or control cars ((L1), (L2), and/or (L3)). When the PTC system is initialized, the consist of the train (TR) is provided to the PTC system, i.e., on or more of the on-board computers 10 of the train (TR). In this embodiment, the consist data (or railway data) includes the train length, train weight, the number of cars that make up the train (TR), a list of all of the locomotives or control cars ((L1), (L2), and/or (L3)), and the locations within the consist of the locomotives or control cars ((L1), (L2), and/or (L3)). With each locomotive or control car ((L1), (L2), and/or (L3)) reporting its location, the PTC system can use the track database 14 to confirm that each specific locomotive or control car ((L1), (L2), and/or (L3)) is correctly indicated in the provided consist. The accuracy of the consist can directly impact the enforcement ability of the PTC system with trains (TR) operating in distributed power mode.

With continued reference to the exemplary embodiment of FIG. 5, the train consist includes three locomotives ((L1), (L2), and (L3)) spread throughout the train (TR). Using this technique, the system 100 can confirm or disprove that the provided train consist accurately indicates the position of each locomotive ((L1), (L2), and (L3)). In this example, it can be demonstrated and verified that not only is the second locomotive (L2) in the correct position, but that the identity of the second locomotive (L2) is "RR Y 345".

As discussed above, effective track navigation is dependent on knowledge of the path through each switch (S) traversed by the train (TR). In one exemplary embodiment, this path determination occurs by comparing "signatures" of possible routes through the switches (S) against the "signature" created by the actual movement of the train (TR). In this embodiment, the signature is in the form of a plot of heading change as a function of position. By using heading change, as opposed to heading, in this embodiment there would be no need for an absolute heading indication, and all evaluation can be generated as relative changes to a starting point.

Figure 6:
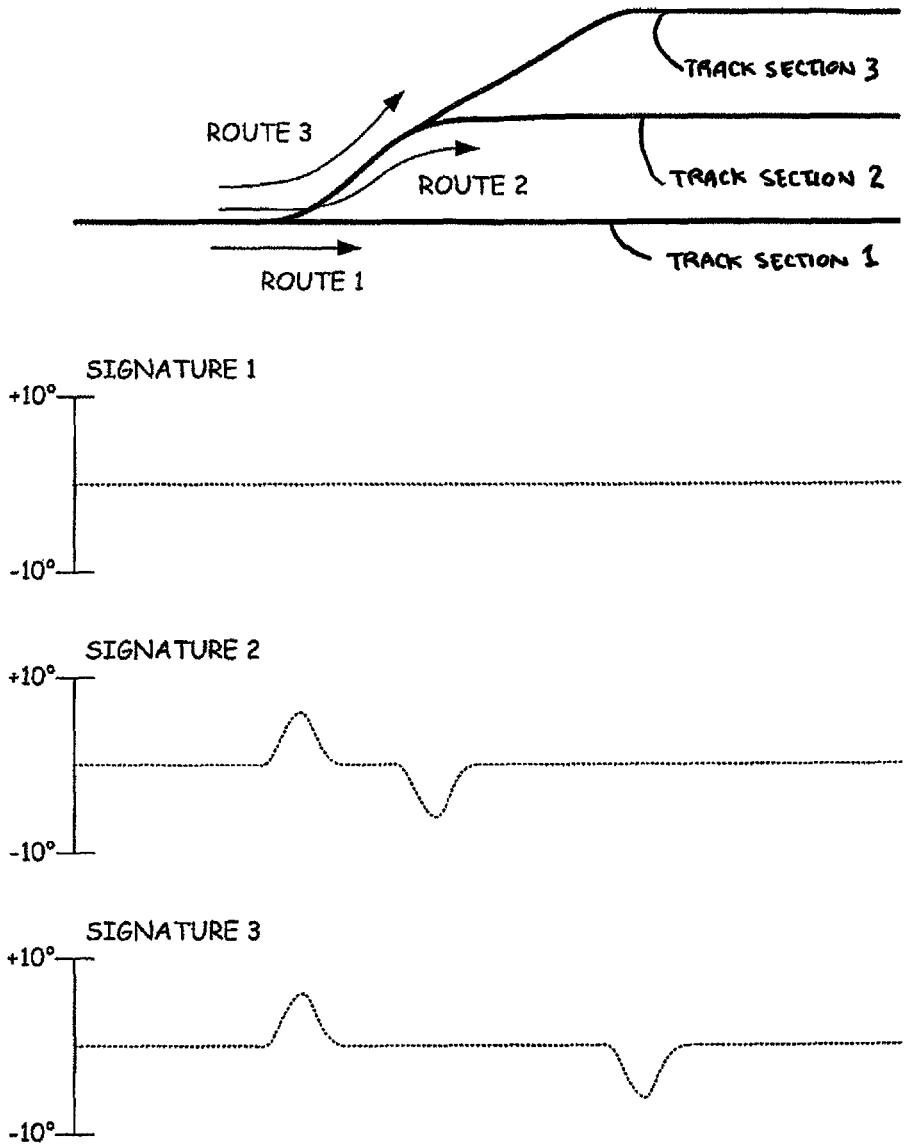
FIG. 6 is a schematic view of another embodiment of a train navigation system according to the principles of the present invention including exemplary route signature data.

In one exemplary embodiment, and as illustrated in FIG. 6, three possible signatures are determined or generated as a result of the train (TR) traversing a combination of two switches (S). Where switches (S) are in close proximity to one another, a signature for the overall combination of potential routes could be generated and used in lieu of a signature combination for each individual switch (S). Which method is selected can depend on the proximity of the switches (S) to one another, and the speed of the train (TR) through the switches (S). In the embodiment illustrated in FIG. 6, it can be readily seen (using the measurements from the inertial sensor 20) that Route 1 is associated with Signature 1, where the train (TR) has not switched track sections (TS) (and remains on Track Section 1); Route 2 is associated with Signature 2, where the movement of the train (TR) indicates that the train (TR) is on Track Section 2; and Route 3 is associated with Signature 3, where the movement of the train (TR) indicates that the train (TR) is on Track Section 3. This same methodology and process can be used in the reverse direction as well, and may also be applied to other trains (TR) operating in the same track area. Further, and as discussed, this process may be used in connection with non-linear track sections (NLT).

Accordingly, the system 100 and method of the present invention provides improved efficiency in navigation for trains (TR), such as trains (TR) involved in commuter operations in terminal areas where there are multiple track sections (TS). These multiple track sections (TS) may have obscured GPS functionality, and are likely to not have all of the traversed switches (S) equipped with wayside interface units (e.g., wayside devices (WD)). As discussed, in one preferred and non-limiting embodiment, the system 100 and method may use inertial sensors 20 to allow a lead locomotive (L1) to navigate through a series of unmonitored switches (S). It may be that, in terminal areas, there is no need for PTC enforcement capability, such that this navigation is primarily used to determine current location so that when the train (TR) leaves the terminal area, it can navigate without crew input to the entry of PTC territory. Further, and since commuter operators run in a push-pull configuration, and the crews swap train ends before leaving a terminal area, the system 100 and method discussed herein provides accurate navigation to the PTC system at each end of the train (TR). In addition, and as discussed, the presently-invented system 100 and method provide the ability of this navigation information to be shared between both ends of the train (TR). Further, this system 100 and method are useful in any type of train control system that requires navigation through switches (S), and for trains (TR) that run in a push-pull configuration.

In one exemplary embodiment, the signature created or associated with the train (TR) can be determined by integrating the time-based rotational sensor measurements to achieve a position-based relative heading measurement. The exact down-track position would not be required in this embodiment, since the key features of the track data signatures can be compared against the signature created by the train (TR) by shifting the signature of the train (TR) in a down-track position until the best match occurs. With this method, the down-track position can be established or adjusted as necessary.

In this manner, the present invention provides an improved navigation system and method for a train.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A navigation system for a train having at least one locomotive or control car and, optionally, at least one railroad car, operating in a track network, the system comprising:

on the at least one locomotive or control car:

(i) an on-board computer programmed or configured to implement or facilitate at least one train action;

(ii) a communication device in communication with the on-board computer and programmed or configured to receive, transmit, and/or process data signals;

(iii) at least one database in communication with the on-board computer with railway data stored therein; and (iv) at least one inertial sensor programmed or configured to generate inertial data;

wherein the on-board computer of the at least one locomotive or control car is programmed or configured to:

(a) determine or receive location data representing at least one of the following: the location or position of the train in the track network, the location or position of the at least one locomotive or control car in the track network, or any combination thereof;

(b) after traversing at least one non-linear track section and/or at least one switch, generate route signature data based at least partially on at least a portion of the inertial data; and (c) communicate or cause the communication of at least a portion of the location data and/or railway data to at least one of the following: at least one other locomotive or control car of the train, at least one other train operating in the track network, at least one remote server, a central controller, a central dispatch server, a switch, a wayside device, a wayside interface unit, a signal device, or any combination thereof.

2. The navigation system of claim 1, wherein, prior to step (a), the on-board computer of the at least one locomotive or control car is programmed or configured to communicate at least a portion of the railway data to at least one other locomotive or control car in the train.

3. The navigation system of claim 2, wherein the railway data comprises at least one of the following: consist data, position data, locomotive or control car data, railroad car data, identification data, length data, weight data, track data, or any combination thereof.

4. The navigation system of claim 2, wherein the on-board computer of the at least one locomotive or control car is programmed or configured to:

receive location data from the at least one second locomotive or control car; and based at least partially on the received location data and the railway data, determine the intended or actual direction of travel of the train.

5. The navigation system of claim 2, wherein the on-board computer of the at least one locomotive or control car is programmed or configured to:

receive location data from the at least one second locomotive or control car; and based at least partially on the received location data and the railway data, validate at least a portion of the railway data.

6. The navigation system of claim 5, wherein the railway data that is validated comprises at least one of the following: consist data, position data, locomotive or control car data, railroad car data, identification data, length data, weight data, track data, or any combination thereof.

7. The navigation system of claim 1, wherein step (a) comprises at least one of the following:

(i) determining at least a portion of the location data based at least partially on railway data in the at least one database;

(ii) determining at least a portion of the location data based at least partially on data received from at least one of the following: at least one other locomotive or control car of the train, at least one other train operating in the track network, at least one remote server, a central controller, a central dispatch server, a switch, a wayside device, a wayside interface unit, a signal device, or any combination thereof;

(iii) determining at least a portion of the location data based at least partially on route data in the at least one database;

(iv) determining at least a portion of the location data based at least partially on data input by or at least partially derived from input by at least one user;

(v) determining at least a portion of the location data based at least partially on inertial sensor data in the at least one database;

(vi) receiving at least a portion of the location data from at least one of the following: at least one other locomotive or control car of the train, at least one other train operating in the track network, at least one remote server, a central controller, a central dispatch server, a switch, a wayside device, a wayside interface unit, or any combination thereof, or any combination thereof.

8. The navigation system of claim 1, wherein the train comprises a first locomotive or control car having an on-board computer and at least one second locomotive or control car having an on-board computer, and wherein step (b) comprises communicating or causing the communication of at least a portion of the location data and/or at least a portion of the railway data from the first locomotive or control car to the at least one second locomotive or control car.

9. The navigation system of claim 8, wherein the location data comprises or is at least partially derived from at least one of the following: track data; route data; signal data; switch alignment data; railway data; sensor data; transponder data; track circuit data; vehicle camera data; crew input; switch position monitor data; positioning system data; sensor data, inertial sensor data; switch alignment data based at least partially on direct or indirect communication with at least one of the following: a switch, a wayside device, a wayside interface unit, a signal device, or any combination thereof; switch alignment data based at least partially on direct or indirect user input; or any combination thereof.

10. The navigation system of claim 8, wherein an on-board computer of the at least one second locomotive or control car is programmed or configured to:

determine location data based at least partially on the received location data and/or the received railway data; and based at least partially on the determined location data, at least one of:

generate at least one independent navigation solution for the at least one train;

determine route data for the at least one second locomotive or control car as a locomotive or control car in a train traversing the track in a second direction;

verify at least a portion of the location data determined by the first locomotive or control car, or any combination thereof.

11. The navigation system of claim 8, wherein at least a portion of the location data is communicated to the at least one second locomotive or control car on at least one of the following bases: periodically, at a specified time, at a specified location, prior to traversing at least one switch, after traversing at least one switch, prior to stopping the train, after stopping the train, prior to initialization of an on-board computer of at least one locomotive or control car, after initialization of an on-board computer of at least one locomotive or control car, or any combination thereof.

12. The navigation system of claim 8, wherein, prior to traversing the track in a second direction, an on-board computer of at least one of the locomotives or control cars is further programmed or configured to determine that at least one of the first locomotive or control car or the at least one second locomotive or control car is in a controlling state.

13. The navigation system of claim 12, wherein the determination is based at least partially on at least one of the following: power data, power interruption data, monitoring data, movement data, wheel data, tachometer data, or any combination thereof.

14. The navigation system of claim 1, wherein the on-board computer of at least one of the locomotives or control cars of the train is programmed or configured to automatically determine the intended or actual direction of travel of the train based at least partially on at least one of the following: location data, route data, signal data, railway data, consist data, length data, weight data, car number data, train data, railroad car data, locomotive or control car data, locomotive or control car position data, railroad car position data, or any combination thereof.

15. The navigation system of claim 14, wherein the determination comprises:

identifying at least one of the locomotives or control cars of the train as the lead locomotive or control car of the train;

receiving location data from at least one other locomotive or control car of the train; and at least partially based on at least a portion of the railway data, which comprises consist data, and relative position with respect to the lead locomotive or control car, determining the intended or actual direction of travel.

16. The navigation system of claim 14, wherein at least a portion of the location data generated by the at least one other locomotive or control car is at least partially derived from at least one positioning system of the at least one other locomotive or control car.

17. The navigation system of claim 14, wherein the determination is further based at least partially on at least one of the following: a control status of at least one locomotive or control car, a control status of a lead locomotive or control car, a reverser position of at least one locomotive or control car, a reverser position of the lead locomotive or control car, an orientation of at least one locomotive or control car, an orientation of the lead locomotive or control car.

18. The navigation system of claim 17, wherein the determination is made prior to movement of the train.

19. The navigation system of claim 1, wherein, while traversing the track in a second direction, the on-board computer of at least one of the locomotives or control cars is further programmed or configured to communicate with specified wayside devices based at least partially on route data derived at least partially from at least a portion of the location data.

20. The navigation system of claim 1, wherein the train comprises a first locomotive or control car having an on-board computer and at least one second locomotive or control car having an on-board computer, wherein the on-board computer of the at least one second locomotive or control car is programmed or configured to communicate or cause the communication of local location data to the first locomotive or control car, wherein the local location data represents the location of the at least one second locomotive or control car.

21. The navigation system of claim 20, wherein at least a portion of the local location data is determined by or at least partially derived from at least one positioning system located on the at least one second locomotive or control car.

22. The navigation system of claim 20, wherein at least a portion of the local location data is at least partially derived by track data in at least one database.

23. The navigation system of claim 20, based at least partially on at least a portion of the railway data in at least one database of the first locomotive or control car, and at least a portion of the received local location data, the on-board computer of the first locomotive or control car is programmed or configured to validate at least a portion of the railway data, thereby generated validated railway data.

24. The navigation system of claim 23, wherein the railway data comprises train data, which includes at least one of the following: consist data, locomotive or control car data, identification data, parameter data, the position of the first locomotive or control car in the train, the position of the at least one second locomotive or control car in the train, the length of the train, the number of locomotives or control cars in the train, the number of railroad cars in the train, weight data, or any combination thereof.

25. The navigation system of claim 23, wherein, at least partially based on at least a portion of the validated railway data, the on-board computer of the first locomotive or control car is programmed or configured to implement at least one of the following: a train braking process, an enforcement process, a train dynamic modelling process, a distributed power modelling process, or any combination thereof.

26. The navigation system of claim 1, wherein the communication device of the at least one locomotive or control car is or utilizes at least one of the following: a messaging service, a direct wired communication link, an Ethernet link, an electrically-controlled pneumatic braking system link, a wireless link, a peer-to-peer communication link, an indirect wireless link, or any combination thereof.

27. The navigation system of claim 1, wherein the train is at least one of the following: a commuter train, a freight train, a distributed power train, or any combination thereof.

28. The navigation system of claim 1, wherein the on-board computer of the at least one locomotive or control car is further programmed or configured to determine at least a portion of the location data based at least partially on the inertial data.

29. The navigation system of claim 1, wherein the at least one inertial sensor comprises a rotational sensor.

30. A navigation system for a train having at least one locomotive or control car, wherein the train is traversing a track with at least one non-linear track section and/or at least one switch for changing paths between track sections, the system comprising:

on the at least one locomotive or control car:

(i) an on-board computer programmed or configured to implement or facilitate at least one train action;

(ii) a communication device in communication with the on-board computer and programmed or configured to receive, transmit, and/or process data signals; and (iii) at least one database in communication with the on-board computer with railway data stored therein; and at least one inertial sensor positioned on the at least one locomotive or control car or on at least one railroad car of the train, wherein the at least one inertial sensor is programmed or configured to generate inertial data;

wherein the on-board computer of the at least one locomotive or control car is programmed or configured to:

(a) after traversing the at least one non-linear track section and/or the at least one switch, generate route signature data based at least partially on at least a portion of the inertial data; and (b) determining a forward route of the train based at least partially on at least a portion of the route signature data.

31. The navigation system of claim 30, wherein at least a portion of at least one of the following: the inertial data, the route signature data, or any combination thereof, is transmitted by the communication device.

32. The navigation system of claim 30, wherein the route signature data is determined as a plot of heading change as a function of position.

33. The navigation system of claim 30, wherein determining the forward route for the train comprises comparing at least a portion of the route signature data to route signature data stored in the at least one database.

34. The navigation system of claim 30, wherein the railway data comprises track data, and wherein determining the forward route for the train comprises comparing at least a portion of the route signature data to a signature generated from at least a portion of the track data.

35. The navigation system of claim 34, wherein, based at least partially on the comparison, the on-board computer of the at least one locomotive or control car is programmed or configured to identify a track section where the train is located.

36. The navigation system of claim 34, wherein, based at least partially on the comparison, the on-board computer of the at least one locomotive or control car is programmed or configured to verify a previously-traversed route of the train.

37. The navigation system of claim 34, wherein the comparison comprises determining a best match between the route signature data and track data, including potential routes, in the at least one database.

38. The navigation system of claim 34, wherein the comparison further comprises determining or receiving location data from at least one positioning system.

39. A computer-implemented navigation method for a train having at least one locomotive or control car and, optionally, at least one railroad car, operating in a track network, the method comprising:

(a) determining or receiving location data representing at least one of the following: the location or position of the train in the track network, the location or position of the at least one locomotive or control car in the track network, or any combination thereof;

(b) after traversing at least one non-linear track section and/or at least one switch, generating route signature data based at least partially on inertial data obtained from at least one inertial sensor positioned on the at least one locomotive or control car; and (c) communicating or causing the communication of at least a portion of the location data to at least one of the following: at least one other locomotive or control car of the train, at least one other train operating in the track network, at least one remote server, a central controller, a central dispatch server, a switch, a wayside device, a wayside interface unit, a signal device, or any combination thereof.

40. A computer-implemented navigation method for a train having at least one locomotive or control car, wherein the train is traversing a track with at least one non-linear track section and/or at least one switch for changing paths between track sections, the method comprising:

(a) positioning at least one inertial sensor on the at least one locomotive or control car or on at least one railroad car of the train, wherein the at least one inertial sensor is programmed or configured to generate inertial data;

(b) after traversing the at least one non-linear track section and/or the at least one switch, generating route signature data based at least partially on at least a portion of the inertial data; and (c) determining a forward route of the train based at least partially on a least a portion of the route signature data.

41. The method of claim 40, wherein the route signature data is generated by determining a plot of heading change as a function of a position of the train.

42. The method of claim 40, wherein the forward route for the train is determined by comparing at least a portion of the route signature data to a signature generated from track data stored in at least one database.

* * * * *